United States Patent [19]

Mohler

[11] Patent Number: 4,855,700

[45] Date of Patent: Aug. 8, 1989

[54] DUAL CONVERSION FORCE MOTOR

[75] Inventor: David B. Mohler, Tipp City, Ohio

[73] Assignee: Lucas Ledex Inc., Vandalia, Ohio

[21] Appl. No.: 310,969

[22] Filed: Feb. 16, 1989

Related U.S. Application Data

[63] Continuation of Ser. No. 226,726, Aug. 1, 1988, Pat. No. 4,847,581.

[51] Int. Cl.[4] ..... H01F 7/08

[52] U.S. Cl. ..... 335/229; 335/230; 335/266

[58] Field of Search ..... 335/266, 229, 230, 234, 335/274, 279, 267

[56] References Cited

U.S. PATENT DOCUMENTS 4,604,599 8/1986 Koehler ..... 335/230

4,635,016 1/1987 Guery et al. ..... 335/230

OTHER PUBLICATIONS

Force Motor-Bertea Control Systems, Div. of Parker Hannifin Corp. Taken from AFWAL-TK-84-2085, vol. II, "Flight Worthiness of Fire Resistant Hydraulic Syts."

*Primary Examiner*—George Harris

*Attorney, Agent, or Firm*—Nixon & Vanderhye

[57] ABSTRACT

Disclosed is a dual working airgap force motor. A centrally located stator includes two toroidally shaped electromagnets wherein the axis of the stator coincides with the axis of the toroids, each toroidal coil is separated from the other toroidal coil by an axial distance. Toroidal permanent magnets are also mounted preferably inside the toroidal electromagnet coils and also spaced apart in an axil direction. The permanent magnets generate a flux flow in opposite axial directions whereas, upon energization, the toroidal coils generate flux flow in the same axial direction at a given radial position. Two armatures are located on an output shaft, in a preferred embodiment at either end of the stator, and each armature is spaced apart from the stator by inner and outer axial airgaps. Energization of the coils with current causes a greater flux flow across the inner and outer airgaps at one end than is caused through the inner and outer airgaps at the other end tending to reduce the airgap at the end with the largest flux flow consequently causing movement of the respective armatures and the output shaft upon which they are mounted.

14 Claims, 3 Drawing Sheets

DUAL CONVERSION FORCE MOTOR

This is a continuation of application Ser. No. 07/226,726, filed Aug. 1, 1988 now U.S. Pat. No. 4,847,581.

BACKGROUND OF THE INVENTION

1. Field of the Invention

The invention relates generally to electrical solenoids that produce a linear, axial force and more specifically to that class of electrical solenoids known as force motors which produce a relatively short displacement which is proportional to a driving current.

2. Description of the Prior Art

Solenoids are generally characterized by an actuation direction which does not change with regard to the direction of the energizing current. In other words, if a direct current supply has its polarity reversed, the solenoid still provides axial movement in the same direction.

Force motors are distinguished from solenoids in that they use a permanent magnet field to prebias the airgap of a solenoid such that movement of the armature of the force motor is dictated by the direction of current in the coil. Reversal of the polarity of current flow will reverse the direction of the force motor armature displacement.

Force motors are frequently used to drive a valve spool in a high performance aircraft where efficiencies of weight, size, cost and power consumption are of prime consideration. It is therefore advantageous to minimize losses associated with producing high magnetic forces and to minimize the size of the permanent magnets which normally have densities and relative costs higher than the solenoid iron.

FIG. 1 in the present application illustrates a conventional force motor with a simplified construction for ease of explanation. A stator 10 includes mounting brackets 12 and an iron core which provides a path for flux travel. The armature 14 is mounted on and moves with output shaft 16. Included in the stator mount is magnet 18 which generates a flux flow through the stator and the armature as indicated by the solid line arrows 20. This flux from magnet 18 travels in opposite directions across airgaps 22 and 24. Coils 26 and 28 are provided and are wound so as to provide flux flow paths indicated by dotted line arrows 30 which cross airgaps 22 and 24 in the same direction. Obviously if the current flow in coils 26 and 28 were reversed the direction of the coil generated flux flow paths shown by dotted line arrows 30 would be reversed for both airgaps 22 and 24. It is noted that the permanent magnet 18 can be mounted in the stator assembly, as shown, or may be part of the armature.

Operation of the prior art force motor provides an output movement by shaft 16 when current in one direction is provided to coils 26 and 28 and movement of the output shaft in the opposite direction When the opposite current flow is provided to coils 26 and 28. This movement direction is caused by the fact that, as shown in FIG. 1, flux flow generated by the permanent magnet 18 (shown by solid line arrows 20) is in the same direction as coil generated flux flow (indicated by dotted line arrows 30) across airgap 22 but in an opposite direction across airgap 24. This causes a greater attraction at airgap 22 than would exist at airgap 24 and thus the armature is attracted towards the left hand stator portion moving the output shaft to the left.

If the coil generated flux flow were reversed (by winding the coil differently or merely reversing the polarity of the direct current supply) the flux flow would be cumulative across airgap 24 and differential across airgap 22 resulting in the armature movement to the right and consequent output shaft movement to the right. Airgaps 22 and 24 are designated working airgaps in which the flux passes through an airgap and, as a result, generates an attractive force between the stator and armature which is in the axial direction. The prior art force motors have an additional airgap 32 which may be characterized as a non-working airgap as flux flow is in the radial direction and thus even though there is an attraction between the stator and armature, this does not result in any increase in force in the axial or operational direction of the force motor. In order to maximize flux flow (minimizing airgaps) this dimension is made as small as possible (minimizing reluctance of the flux flow path) although a sufficient clearance must be maintained to allow for relative movement between the stator and armature.

It will be further recognized by those familiar with the utilization of permanent magnets in force motors that the magnet will have a preferred optimum energy product point on its de-magnetization curve about which the magnet should operate for maximum efficiency. The closer the magnet operates to this point, the smaller the magnet can be. Further, the magnet length, cross sectional area and strength are dictated by the level of flux required to drive through the magnetic circuit to achieve the desired performance of the force motor. Thus, force motors having a high force requirement typically have a low reluctance magnetic path due to the cross sectional area of the iron necessary for producing high forces and a relatively large volume of permanent magnets to produce the necessary airgap flux. Of course, attendant with the desired high flux level of a low reluctance magnetic circuit are losses which may be expressed in ampere-turns in the iron and also in the non-working airgap(s) which further detract from the efficiency of the motor. These losses are accounted for by increases in the electrical power source and/or the requirement of a larger permanent magnet than would otherwise be necessary.

SUMMARY OF THE INVENTION

It is an object of the present invention to provide a force motor whose magnetic circuit minimizes energy losses inherent in prior art force motors.

It is a further object of the present invention to reduce the overall mass of a force motor to be less than that of prior art force motors for a given force/displacement requirement.

It is a further object of the present invention to reduce the volume and/or mass of permanent magnet material utilized in a force motor and its associated costs.

The above and other objects are achieved in accordance with the present invention by providing a magnetic circuit of relatively higher reluctance but having airgaps only in a direction which contributes to force production, i.e., in the axial direction of the force motor and to eliminate the need for a non-working airgap. A stator is provided with two axially separated coils mounted therein, said coils wound in the conventional manner for a force motor. Adjacent either end of the stator are two separate armatures where the armatures are separated from the stator by working airgaps both inside of and outside of the coils and the gaps extending in an axial direction. Permanent magnets are provided to generate a flux flow across the respective working airgaps in opposite directions so as to operate in a manner similar to the prior art force motor. However, because the present invention does not have a radial non-working air gap there is no attendant increase in reluctance and decrease in flux flow and therefore decrease in operational efficiency due to flux being forced to flow in a radial direction across a non-working airgap. Consequently, a higher force output for a given force motor size can be achieved.

BRIEF DESCRIPTION OF THE DRAWINGS

The present invention will be better understood by reference to the following exemplary drawings wherein.

DETAILED DESCRIPTION OF PREFERRED EMBODIMENTS

Figure 2:
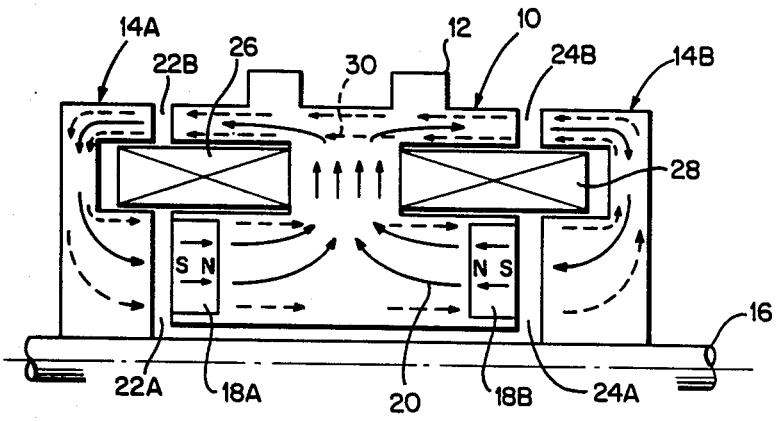
FIG. 2 is a schematic representation of flux flow in a force motor in accordance with the present invention.

FIG. 2 illustrates schematically one embodiment of the present invention. Stator 10 includes mounting flanges 12 for fixing the position of the stator with respect to two armatures 14*a* and 14*b*. The armatures are fixedly mounted on shaft 16 and are positioned for axial movement relative to the stator in the operational direction of the force motor. The mounting structure which permits such movement is not shown in FIG. 2 for clarity of illustration.

Coils 26 and 28 are wound as in the prior art. A single permanent magnet could be used and mounted essentially between the coils as in the prior art although in a preferred embodiment two separate permanent magnets 18*a* and 18*b* are used. The flux path generated by the permanent magnets is represented by solid line arrows 20 and the flux generated by electromagnets 26 and 28 is shown by dotted line arrows 30.

It can be seen in FIG. 2 that the flux generated by the permanent magnets and the electromagnets must pass across two axial working gaps 22*a* and 22*b* associated with electromagnet 26 and permanent magnet 18*a* and two additional axial working airgaps 24*a* and 24*b* associated with coil 28 and permanent magnet 18*b*. It will also be seen that there is no radial flux flow across any non-working airgap. The fact that all airgaps in the present invention are in the working direction, (i.e., all airgap flux travel is in the axial direction) a lower level of flux will be necessary to provide the same force output from shaft 16. This is a reduction in flux required to by generated by the permanent magnets 18*a* and 18*b* and allows them to be even smaller because there is a consequent reduction in iron core losses.

Figure 1:
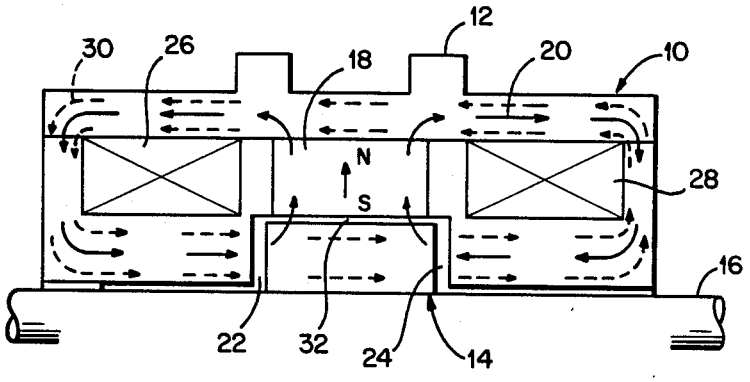
FIG. 1 PRIOR ART
FIG. 1 is a schematic illustration of flux flow in a conventional prior art force motor.

As regards operation of the invention of FIG. 2 it operates in a similar manner to FIG. 1. Flux flow from permanent magnet 18*a* and coil 26 accumulates across both airgaps 22*a* and 22*b* while at the same time flux flow generated by permanent magnet 18*b* and coil 28 differentiates across airgaps 24*a* and 24*b*. Consequently, armature 14*a* will be attracted toward the stator with a much greater force than will armature 14*b* causing output shaft 16 to move to the right in FIG. 2.

Figure 4B:
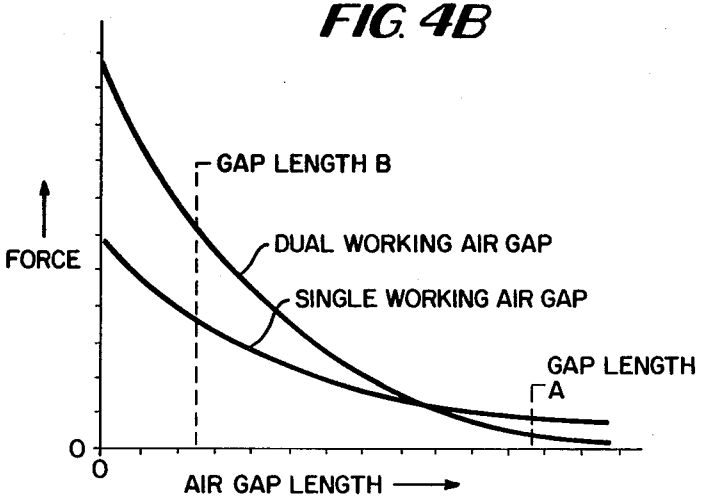
FIG. 4*b* is a graph comparison of single vs. dual working airgap force motors indicating force for various airgap lengths.
Figure 4A:
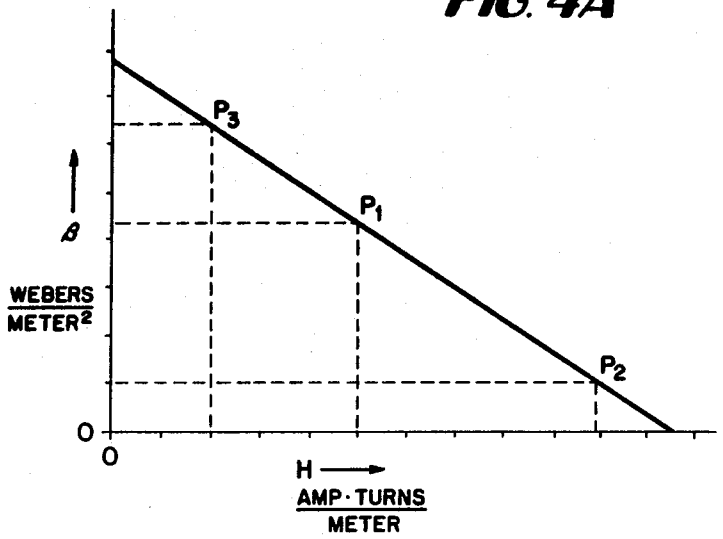
FIG. 4*a* is a graph of a demagnetization curve for a conventional permanent magnet showing flux density vs. magnetic intensity.

One advantage of the present invention over the prior art force motor can be seen by referring to FIG. 4*a* which is a graph of the demagnetization curve for the magnets. It shows that the maximum energy product area (the product of $H \times B$) is when the flux density of the magnet is at point P1. It will be noted that an open circuited magnet (no point accompanying iron core) will have a large H (low flux density but high ampere-turns per unit length) as represented by Point P2 on the curve and a magnet in a low reluctance iron circuit will have a high flux density B and a low H as noted at Point P3. Both points P2 and P3 have low energy product areas and are not ideal operating points. For operating point P3 to move toward P1, the magnet size must increase or the reluctance of the iron circuit must increase. It is the latter which is accomplished by the present invention in that it replaces the radial non-working airgap whose reluctance is typically made as low as practicable. Thus because the present circuit has a greater reluctance caused by the presence of two working airgaps for every one working airgap of the prior art, it operates at about Point P1 at a reduced flux level which permits a smaller permanent magnet and reduced losses in the iron.

A second advantage for the force motor in accordance with the present invention is related to the maximizing of the attainable force for a given size of the motor. The utilization of essentially two working airgaps instead of the single working airgap of the prior art allows the force capability to be doubled. However, due to the large difference in circuit reluctances of the prior art motor and the present invention, a doubled force improvement is not realized for all conditions and this can be explained by FIGS. 4*b* and 4*c*.

In FIG. 4*b* it can be seen that there is a crossover point at a given airgap length where the single airgap, prior art low reluctance motor will pass through a point of maximum iron permeability and be approaching saturation while the higher reluctance motor will be approaching its point of maximum iron permeability. Beyond the point of maximum permeability of the low reluctance motor (the prior art motor) the permeability (B/H) of the high reluctance motor (present invention) will always be higher assuming equal iron paths, airgap length and coil EMF with its consequent higher force advantage.

Figure 4C:
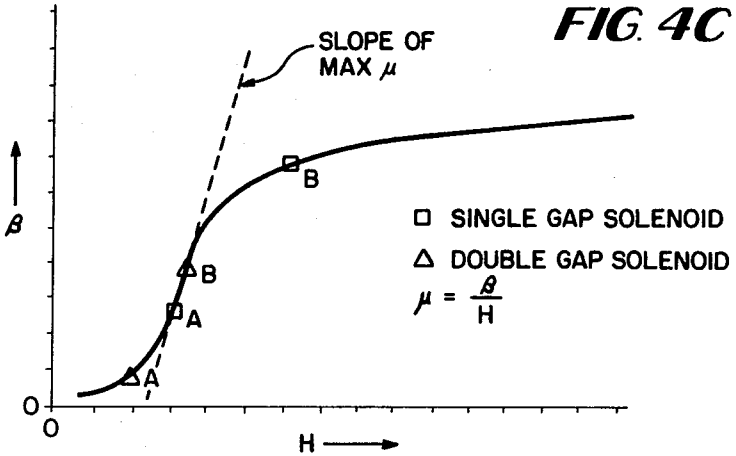
FIG. 4*c* is a graph of flux density vs. magnetic intensity for single and double airgap solenoids.

As seen in FIG. 4*c* permeability $\mu$ is equal to B (the flux density) divided by H and it can be seen that both the single gap solenoid (the prior art solenoid) and the double gap solenoid (the present invention) have operating ranges A to B which are the gap lengths A and B shown in FIG. 4*b*. Therefore, it can be seen that both force motors can operate at the maximum permeability which is the dotted line shown in FIG. 4*c*. However, it can also be seen that for a large portion of airgap lengths the dual working airgap is closer to the maximum permeability than the single working airgap as noted in FIG. 4*b*. This is why, when operating in this region (from the crossover point in FIG. 4*b* to the left), the dual working airgap has a dramatically greater force than the prior art force motor even though it might have the same iron paths, airgap length and coil EMF. It can also be seen that in order to generate the same force, the dual working airgap force motor would have a smaller coil, smaller magnet and smaller iron core thus providing significant cost and weight savings.

Figure 3A:
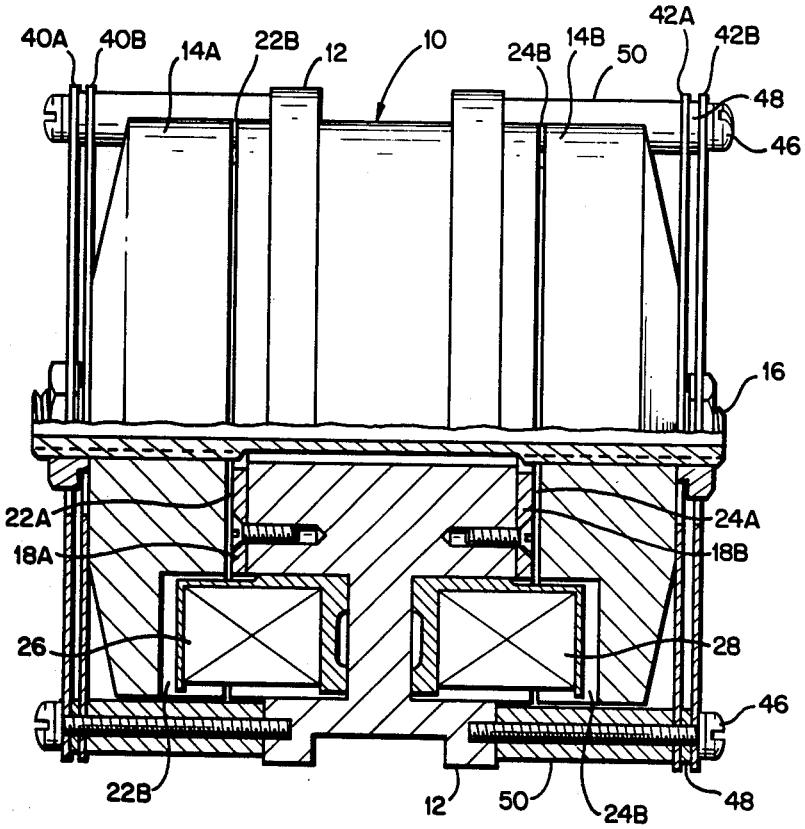
FIG. 3*a* is a side view of a force motor according to the present invention partially in section.
Figure 3B:
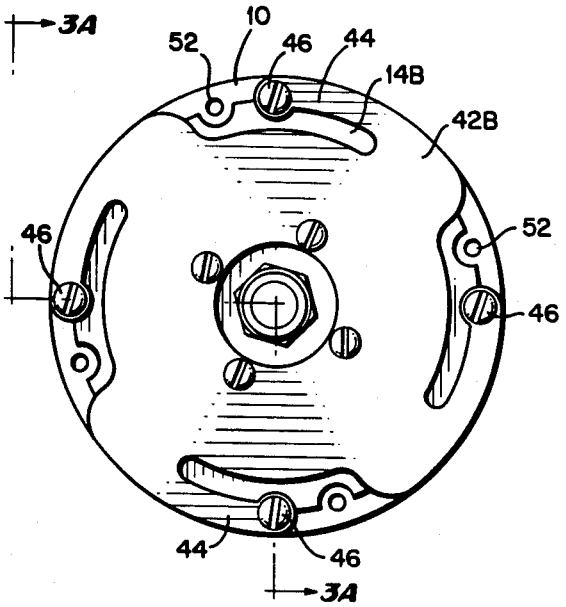
FIG. 3*b* is an end view of the force motor in accordance with the present invention.

One preferred embodiment of applicant's invention is shown in FIGS. 3*a* and 3*b* where FIG. 3*a* is a partial cross section of FIG. 3*b* along section lines 3*a*—3*a*. Structures identified in FIG. 3*a* are all labeled with the same labeling as those in FIG. 2. Stator 10 includes mounting flanges 12 integral therewith. However, the mounting of the armature relative to the stator is shown in FIG. 3*a* and 3*b* although it was eliminated for purposes of clarity from FIG. 2.

It can be seen that 4-arm springs 40A, 40B, 42A and 42B are shown in FIG. 3*a*. The configuration of each spring is similar to spring 42B shown in FIG. 3*b* in which there are 4 separate arms 44 having ends which are connected to the stator through machine screw 46 which passes through small spacer 48, large spacer 50 and is secured into an appropriately threaded aperture in the mounting flange 12 of stator 10. Similarly, armature **14*b* is not only connected to output shaft 16 but is also fixedly connected to the central portion of 4-arm springs 42*a* and 42*b*. In this configuration the stator 10 and armature 14*b* can move relative to each other only in an axial direction. A similar arrangement is used to secure armature 14*a* through 4-arm springs 40*a* and 40*b* to the mounting flange 12 of stator 10. Therefore, while armatures 14*a* and 14*b* are fixedly mounted with respect to each other and output shaft 16, they are free to move in an axial direction with respect to the stator 10**.

Mounting holes 52 permit the stator 10 to be bolted through another set of spacers and machine screws (not shown) to any flat structure. Alternatively, mounting tabs arranged in a circular mounting hole and extending inwardly could be used in conjunction with short machine screws to mount the stator in its operational position. It is important to note that because the large spacer 50 and the machine screw connect the 4-arm springs to both the stator 10 and armatures **14*a* and 14*b*, it is important that the spacers and screws be non-magnetic as they would otherwise permit flux leakage around the outside working airgaps (22*b* and 24*b*). For the same reason output shaft 16 would be nonmagnetic to prevent flux leakage around the inner airgaps 22*a* and 24*a***.

It will be obvious to those of ordinary skill in the art, in view of the above disclosure, that there will be many modifications which can be made to the above invention depending upon the particular application desired. For example, in order to obtain a greater amount of force in the axial direction additional permanent magnets and electromagnets, stators and armatures could be included along the output shaft, making a relatively long but narrow cylindrical force motor. On the other hand, should a very short but wide construction force motor be desired, additional airgaps, permanent magnets and electromagnets could be located radially outwards of the existing airgaps, permanent magnets and electromagnets.

Although the present device shows stator 10 fixedly mounted ad armatures **14*a* and 14*b* mounted on shaft 16 for an output movement, it is possible depending upon a particular application that armatures 14*a* and 14*b* and output shaft 16 could be fixed and that stator 10 would provide the output movement of the force motor. In this instance, if it was desirable to reduce the inertia of stator 10, both the permanent magnets 18*a* and 18*b* and the electromagnets 26 and 28 would be mounted on armatures 14*a* and 14*b***, respectively.

As noted previously, the location of the permanent magnets can be as illustrated in the prior art device and/or as illustrated in FIG. 2. The permanent magnets could also be located and fixed relative to the armature so that it moves with the armature. There would be a disadvantage in that this would increase the inertia of the armature but this may be desirable in some circumstances. Similarly, the electromagnets themselves, although shown in FIG. 2 as being fixed with respect to the stator, could be fixed with respect to the armatures although this would increase the inertia of the armature. Therefore, it is envisioned that all of the above modifications and derivations of the present invention are encompassed by the scope of this patent application.

What is claimed is:

1. A force motor having an axis of operation, said force motor comprising:

a stator having two sides spaced apart along said axis;

an armature having two portions, one portion located on one side of said stator and another portion located on another side of said stator, said stator and armature including means defining radially inner and radially outer working airgaps between each armature portion and said stator;

first means for generating a magnetic flux flow through said one armature portion across said one inner working airgap, through said stator, across said other inner working airgap through said other armature portion, across said other outer working airgap, through said stator, across said one outer working airgap, and back to said one armature portion; and second means for generating a magnetic flux flow in said one armature portion and said stator in coincidence with said first means flux flow therein and for generating a magnetic flux flow in said other ar portion and said stator in opposition to said first means flux flow therein.

2. A force motor according to claim 1, wherein said second means comprises at least one permanent magnet.

3. A force motor according to claim 2, wherein said at least one permanent magnet is mounted in said stator.

4. A force motor according to claim 1, wherein said first means comprises at least two coils.

5. A force motor according to claim 4, wherein said first are located on and mounted by said stator.

6. A force motor according to claim 1, further including means for mounting said armature portions for movement relative to said stator.

7. A force motor according to claim 6, wherein said mounting means comprises at least one spring plate, said at least one spring plate having arms and a central portion, said mounting means further comprises means for connecting said central portion to said armature and for connecting said arms to said stator.

8. A force motor according to claim 7, wherein said stator is fixed and said armature portions move relative to said stator but not relative to each other.

9. A force motor according to claim 1, wherein said first means comprises a coil means; and said second means comprises a bias means.

10. A force motor according to claim 3, wherein at least two permanent magnets are mounted in said stator.

11. A force motor according to claim 6, wherein said first means comprises at least two coils and said second means comprises at least one permanent magnet.

12. A force motor according to claim 7, wherein said first means comprises at least two coils and said second means comprises at least one permanent magnet, said coils and said permanent magnet mounted in said stator.

13. A force motor according to claim 8, wherein said first means comprises at least two coils, said second means comprises at least two permanent magnets, said at least two coils and said at least two permanent magnets being mounted on said stator.

14. A force motor according to claim 1, wherein said second means comprises at least two permanent magnets mounted on said stator, each of said magnets having north/south polarity and mounted parallel to said axis of operation, one permanent magnet having its north/south polarity reversed from the north/south polarity of the other of said permanent magnets.

* * * * *